US005705979A

United States Patent [19]

Fierro et al.

[11] Patent Number: 5,705,979

[45] Date of Patent: Jan. 6, 1998

[54] SMOKE DETECTOR/ALARM PANEL INTERFACE UNIT

[75] Inventors: Robert A. Fierro, Seaside Heights; Bruce A. Meyer, Bridgewater, both of N.J.

[73] Assignee: Tropaion Inc., Matawan, N.J.

[21] Appl. No.: 421,086

[22] Filed: Apr. 13, 1995

[51] Int. Cl.[6] ..... G08B 23/00

[52] U.S. Cl. ..... 340/517; 340/506; 340/514; 340/538; 340/533

[58] Field of Search ..... 340/506, 507, 340/508, 514, 531, 533, 538

[56] References Cited

U.S. PATENT DOCUMENTS

| | | | |
|---|---|---|---|
| 3,964,047 | 6/1976 | Antonaccio | 340/538 |
| 3,978,461 | 8/1976 | DeLime, III | 340/227 |
| 3,984,761 | 10/1976 | Edington et al. | 323/9 |
| 4,004,288 | 1/1977 | Webb, Jr. | 340/237 |
| 4,199,754 | 4/1980 | Johnson et al. | 340/577 |
| 4,207,558 | 6/1980 | Kunzer | 340/524 |
| 4,223,303 | 9/1980 | Albinger, Jr. | 340/531 |
| 4,419,658 | 12/1983 | Jarosz et al. | 340/521 |
| 5,053,752 | 10/1991 | Epstein et al. | 340/628 |

*Primary Examiner*—Jeffrey Hofsass
*Assistant Examiner*—Daryl C. Pope
*Attorney, Agent, or Firm*—David L. Davis

[57] ABSTRACT

An interface unit interposed between a central alarm panel and a string of smoke detectors interconnected by a three-wire bus. Two wires of the bus carry AC power and the third wire is an interunit signalling wire. When an individual detector senses a smoke condition, it places a voltage on the signalling wire. The other detectors sound their alarms upon detecting this voltage. The interface unit senses this voltage and notifies the central alarm panel, with the sensing circuitry having a variable high input impedance and being powered solely from the signalling wire. The interface unit includes a test button which, when actuated, disables communications to the central alarm panel for a predetermined period of time. During this time, the interface unit places a periodic signal on the signalling wire, which causes all of the detectors to "beep" while that signal is present. The interface unit also senses the absence of AC power on the bus for notifying the alarm panel of such AC power failure. Audible alarms are energized upon sensing either smoke detection or AC power failure, with these audible alarms being distinguishable one from the other.

25 Claims, 5 Drawing Sheets

SMOKE DETECTOR/ALARM PANEL INTERFACE UNIT

BACKGROUND OF THE INVENTION

This invention relates to alarm systems and, more particularly, to an interface unit adapted to be interposed between a .plurality of alarm devices and an alarm panel for signalling the alarm panel when any one of the plurality of alarm devices senses an alarm condition and for providing a controlled test capability of the alarm devices.

In those states which have adopted the National Fire Code, according to Section 72 thereof new home construction requires the installation of smoke detectors which are interconnected, typically by a three wire bus which includes a pair of AC power wires and a signalling wire, so that when any one of the detectors is activated due to sensing the presence of smoke, all of the detectors sound an alarm. Further according to the Code, the detectors are AC powered from the bus with battery backup.

If a homeowner later wishes to install an alarm system having a central alarm panel which signals a remote monitoring station upon detection of an alarm condition, the alarm system installer will attempt to sell to the homeowner a set of smoke detectors designed to cooperate with the central alarm panel, even though the existing smoke detectors are still functional. This has several disadvantages to the homeowner. For example, installation of the new smoke detectors and the attendant wiring can be extremely messy, requiring that holes be made, and then patched, in ceilings and walls. Further, the new smoke detectors duplicate the function of, and are more expensive than, the existing functional smoke detectors. It is therefore an object of the present invention to provide an arrangement which can act as an interface between existing interconnected smoke detectors and a central alarm panel.

A home fire is often started by a lightning strike which also cuts off the AC power. Further, sometimes the fire itself causes an AC power failure before smoke is detected. An electrical fire can also result in AC power failure. The central alarm panels have a battery backup so that they are insensitive, at least for a certain amount of time, to such a power failure. It is therefore another object of the present invention to provide an interface unit, as described above, which is effective to notify the central alarm panel in the event of smoke detection even if there has been a failure of the AC supply.

It is a further object of the present invention to provide such an interface unit with the capability of testing the integrity of the detector interconnection wiring and the individual detector unit audible alarms without activating the central alarm panel, since such activation can result in the sending of an undesirable "false alarm" to the remote monitoring station.

It is still another object of this invention to provide such an interface unit which signals the central alarm panel upon detection of an AC power failure on the bus interconnecting the smoke detectors.

It is yet another object of this invention to provide such an interface unit with distinguishable audible alarms for smoke detection and AC power failure detection.

SUMMARY OF THE INVENTION

The foregoing and additional objects are attained in accordance with the principles of this invention by providing an interface unit adapted to be interposed between at least one alarm device and an alarm panel. The alarm device is coupled to a signalling wire and is arranged to provide a predetermined voltage on the signalling wire in response to the sensing of an alarm condition and is further arranged to provide an audible signal in response to sensing the predetermined voltage on the signalling wire. The interface unit is connected to the signalling wire and includes sensing means responsive to the presence of the predetermined voltage on the signalling wire for providing a predetermined electrical current at its output, the sensing means being isolated from any source of voltage other than the signalling wire. The interface unit also includes alarm notification means which is coupled to the sensing means output and is responsive to the predetermined electrical current for providing an alarm condition signal to the alarm panel.

In accordance with an aspect of this invention, the sensing means and the alarm notification means are electrically isolated one from the other.

In accordance with another aspect of this invention, the interface unit includes a test switch for initiating a test of the alarm device, voltage providing means responsive to the test switch being actuated for applying the predetermined voltage to the signalling wire, and inhibit means responsive to the test switch being actuated for inhibiting operation of the alarm notification means.

In accordance with still another aspect of this invention, the signalling wire is part of a three wire bus having a pair of wires connectable to an AC power source for providing primary power to the alarm device and the interface unit includes AC monitor means coupled to the two AC wires of the bus for providing a first signal when AC power is not present on the bus, AC failure detection means responsive to the first signal for providing an AC failure signal, and power failure notification means responsive to the AC failure signal for providing a power failure signal to the alarm panel.

In accordance with a further aspect of this invention, the alarm device is a smoke detector.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
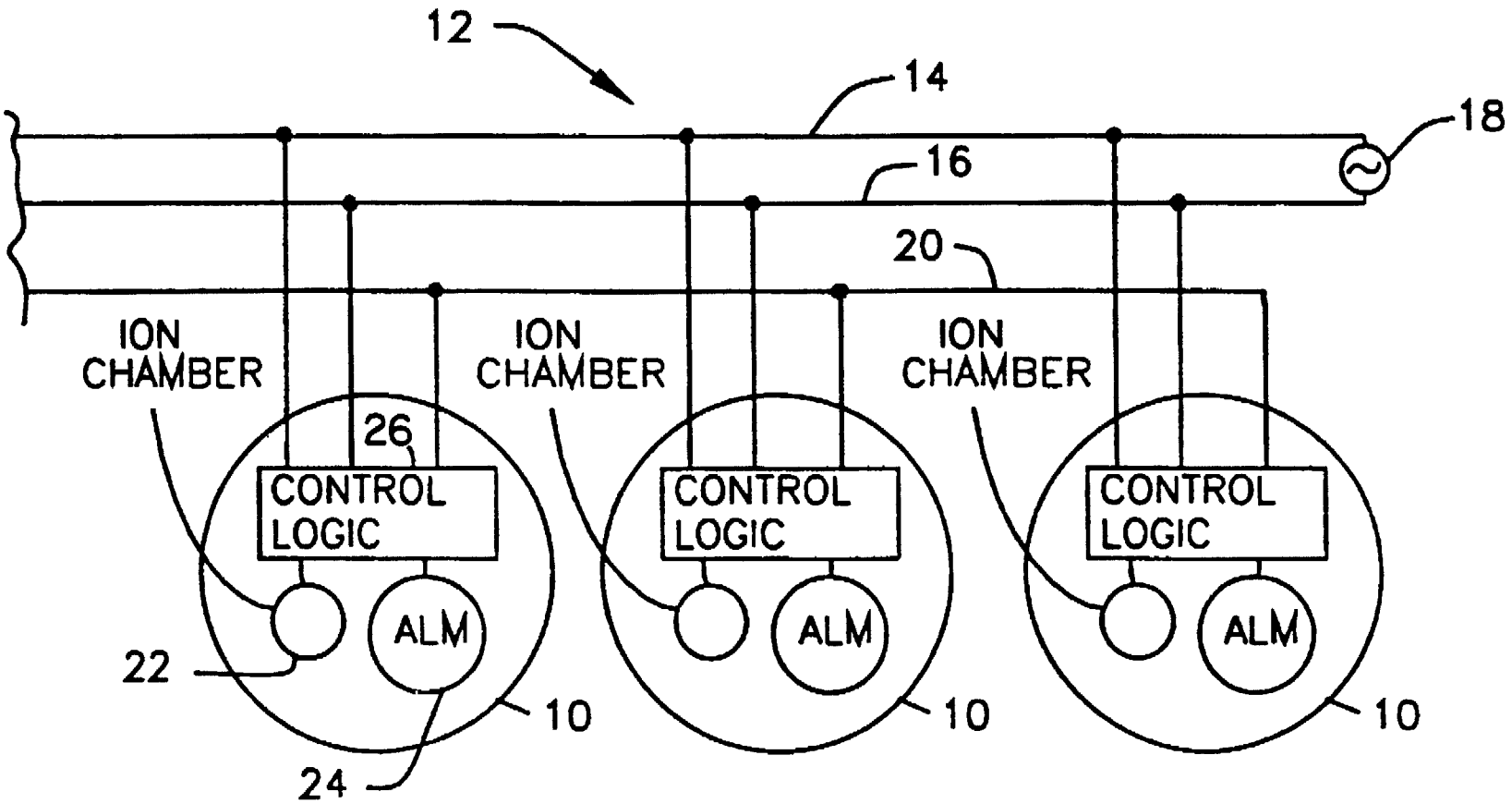
FIG. 1 is a block diagram showing a plurality of prior art smoke detectors interconnected in accordance with Section 72 of the National Fire Code.

FIG. 1 illustrates a plurality of smoke detectors 10 interconnected in accordance with Section 72 of the National Fire Code. This interconnection is via a three wire bus 12 having a pair of wires 14, 16 connected to AC power source 18, and a signalling wire 20. Power source 18 is typically commercially available residential 60 Hertz 115 volt AC power.

As is conventional in the art, each of the smoke detectors 10 includes an ionization chamber 22, an audible alarm 24 and control logic 26 connected to both the chamber 22 and the alarm 24, as well as to the bus 12. As is well known, the control logic 26 responds to a signal from the ionization chamber 22 in the presence of smoke for energizing the audible alarm 24 and also for placing a predetermined signal on the signalling wire 20. The predetermined signal on the signalling wire 20 is conventionally a fixed voltage, typically in the range from about 3 volts DC to about 5 volts DC. The control logic 26 in each of the smoke detectors 10 is further responsive to the presence of the predetermined signal on the signalling wire 20 for energizing its respective audible alarm 24. The smoke detector 10 is primarily powered from the AC power source 18 over the wires 14, 16, but contains a battery backup (not shown) in the event of a failure of the primary power source 18.

Figure 2:
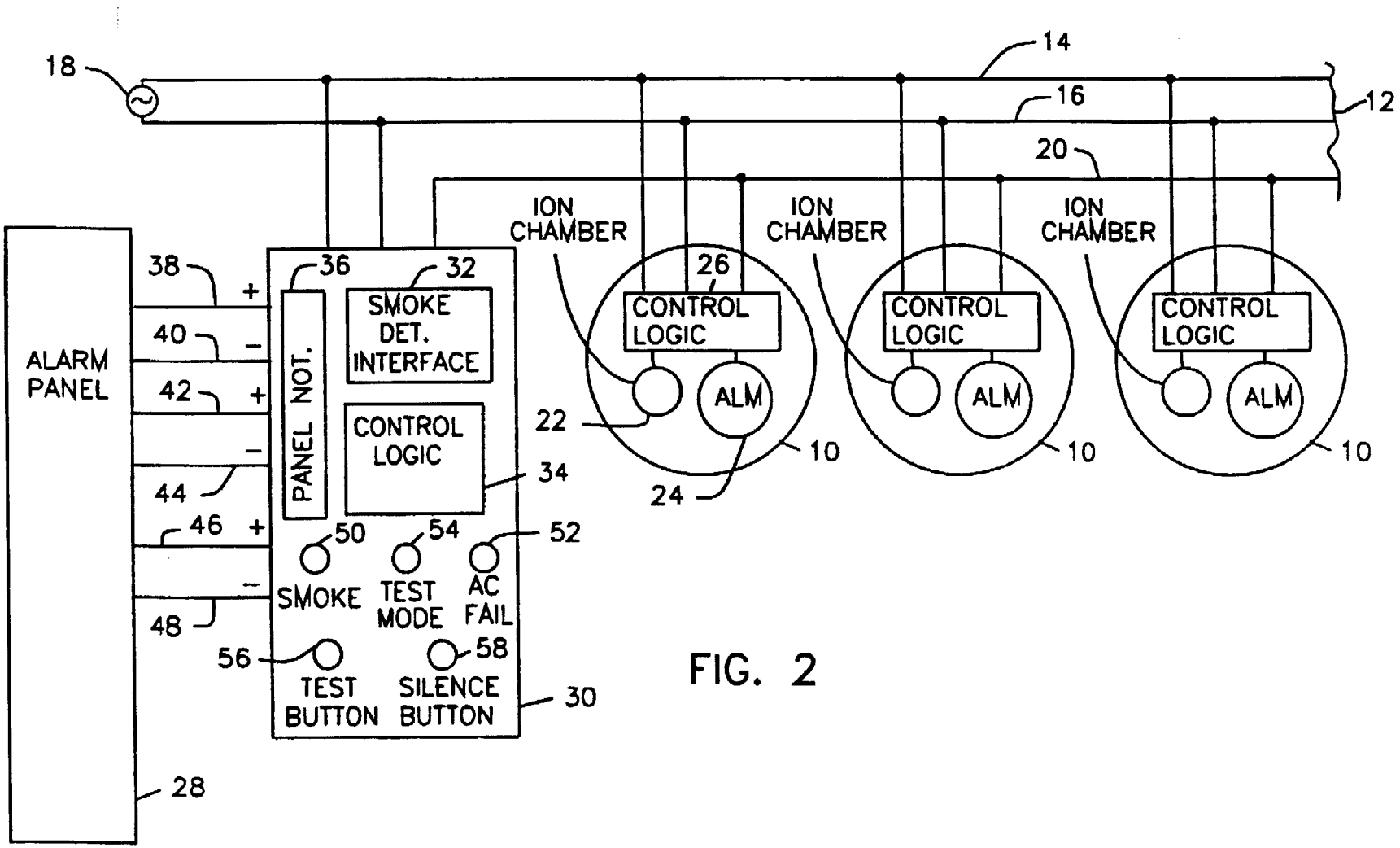
FIG. 2 is a block diagram showing an interface unit according to the present invention interposed between the detectors of FIG. 1 and a central alarm panel.

According to the present invention, as shown in FIG. 2, an existing network of smoke detectors 10 interconnected via the bus 12 can be coupled to an industry standard remote alarm (central office monitoring) control panel 28 by an interface unit 30. As will be described in full detail hereinafter, the interface unit 30 includes a smoke detector interface 32 coupled to the bus 12 for providing signals to the control logic 34 concerning the status of the signalling wire 20 and power on the wires 14, 16. The control logic 34 communicates with the alarm panel 28 via the panel notification circuitry 36 to provide a smoke detection signal over the wires 38, 40 in the event of the detection of a smoke condition by any one of the smoke detectors 10 and an AC failure signal over the wires 42, 44 in the event the interface unit 30 detects the lack of AC power on the wires 14, 16. Power for the interface unit 30 is provided over the wires 46, 48 from the alarm panel 28 so that the interface unit 30 operates in the absence of AC power to the detectors 10.

The interface unit 30 also has the capability of testing the integrity of the signalling wire 20 and the audible alarms 24. of the smoke detectors 10. The interface unit 30 is further provided with a visual indicator 50 which is energized in response to the detection of a smoke condition, a visual indicator 52 which is energized in response to the detection of lack of AC power on the wires 14, 16, and a visual indicator 54 which is energized when the interface unit 30 is placed in the test mode. The interface unit 30 also has an audible indicator (not shown in FIG. 2) which provides audible signals to accompany energization of the visual indicators 50, 52. As will be described hereinafter, the audible signals for smoke detection and AC failure are distinguishable one from the other. For initiating the test mode, the interface unit 30 has a test button 56, illustratively a momentary contact switch. Further, the interface unit 30 has a silence button 58, illustratively a momentary contact switch, by means of which the user can terminate the test mode or silence the audible alarm if it has been caused by AC failure, but not if it has been caused by smoke detection.

Figure 3:
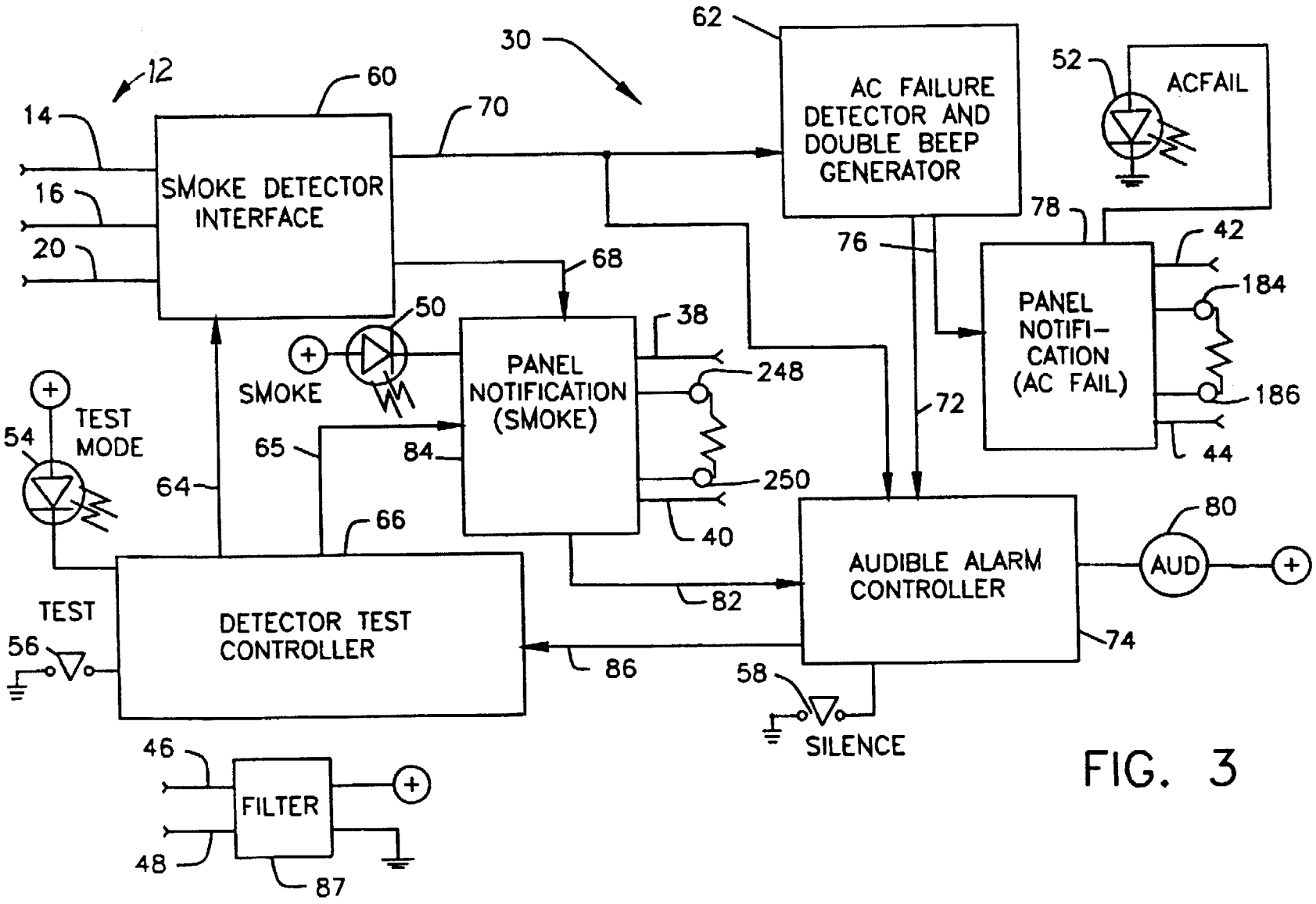
FIG. 3 is a block diagram of an interface unit constructed in accordance with the principles of this invention.

As shown in FIG. 3, the interface unit 30 is made up of six major functional blocks. The smoke detector interface 60 provides a high impedance interface to the signalling wire 20 in order to assure proper operation of the installed smoke detectors 10. The smoke detector interface 60 also monitors the power wires 14, 16 to provide a signal to the AC failure detector and double beep generator circuit 62 and also provides a test signal to the signalling wire 20, using power derived from the power wires 14, 16, upon operator actuation of the test button 56. The inputs to the smoke detector interface 60 include the three wire bus 12, along with a test command input lead 64 from the detector test controller 66. The outputs of the smoke detector interface 60 include a smoke detection output lead 68 and an AC output lead 70.

The circuit 62 monitors the AC output lead 70 to determine whether AC failure has occurred. If so, it provides a signal over the lead 72 to the audible alarm controller 74, as well as a signal over the lead 76 to the panel notification circuit 78.

The audible alarm controller 74 drives an audible indicator 80 when it receives either an AC failure signal over the lead 72 or a smoke detection signal over the lead 82. As will be described hereinafter, the audible signals are different for these two different conditions. Illustratively, the audible signal for smoke detection is continuous, whereas the audible signal for AC failure consists of two "beeps", each about one second long and separated by one second, about every twenty seconds. Logic within the audible alarm controller 74 allows the user to actuate the silence button 58 in order to silence the audible alarm 80 if it is caused by AC failure, but not if it is caused by detection of smoke. The AC output lead 70 is monitored so that the audible indicator 80 is silenced upon restoration of AC power.

The detector test controller 66 responds to user actuation of the test button 56 for changing state into its test mode. When in the test mode, the controller 66 provides pulses over the test command lead 64 to the smoke detector interface 60, which places a pulsed test signal on the signalling bus 20. The test pulses are about one second long and occur about every twenty seconds for about five minutes. A test mode signal on the lead 65 is also provided to the panel notification circuit 84 to inhibit transmission of a false alarm indication to the alarm panel 28. The detector test controller 66 also energizes the test light 54 when it is in its test mode. The detector test controller 66 leaves its test mode either upon timing out or upon receipt of an end test signal over the lead 86 from the audible alarm controller 74 in response to actuation of the silence button 58.

The panel notification circuit 78 signals the alarm panel 28 over the leads 42, 44 when AC failure is detected. The panel notification circuit 84 signals the alarm panel 28 over the leads 38, 40 in the event a smoke condition is detected, provided it is not inhibited by a test mode signal over the lead 65.

Power for the logic circuitry within the functional blocks of the interface unit 30 is provided through the filter 87 from DC power provided by the alarm panel 28 over the leads 46, 48. Illustratively, the filter 87 includes the diode 89 and the capacitor 91 (FIG. 4A).

Figure 4A:
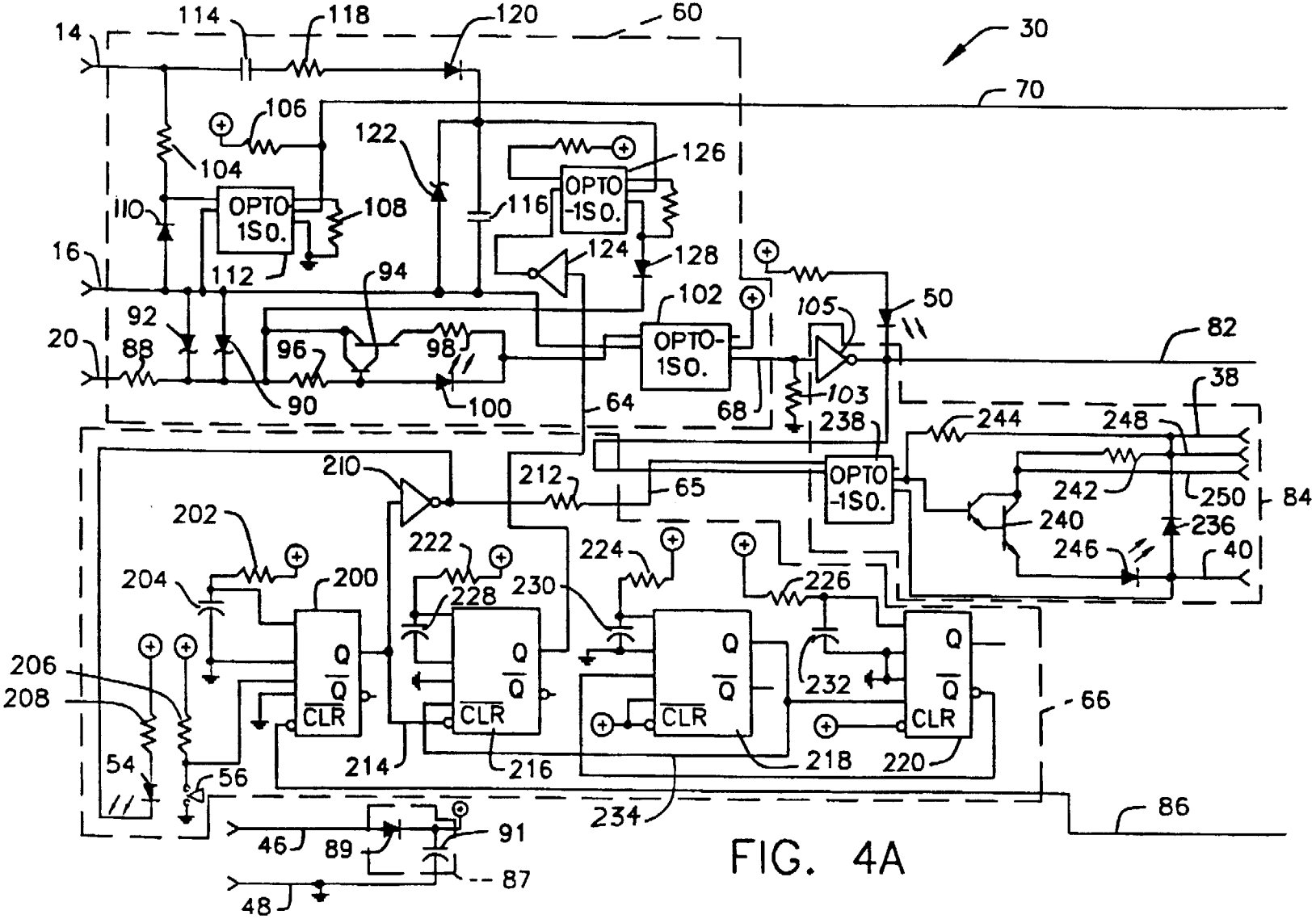
FIGS. 4A and 4B, when placed side-by-side, together provide a detailed schematic electric circuit diagram of an illustrative interface unit according to this invention.
Figure 4B:
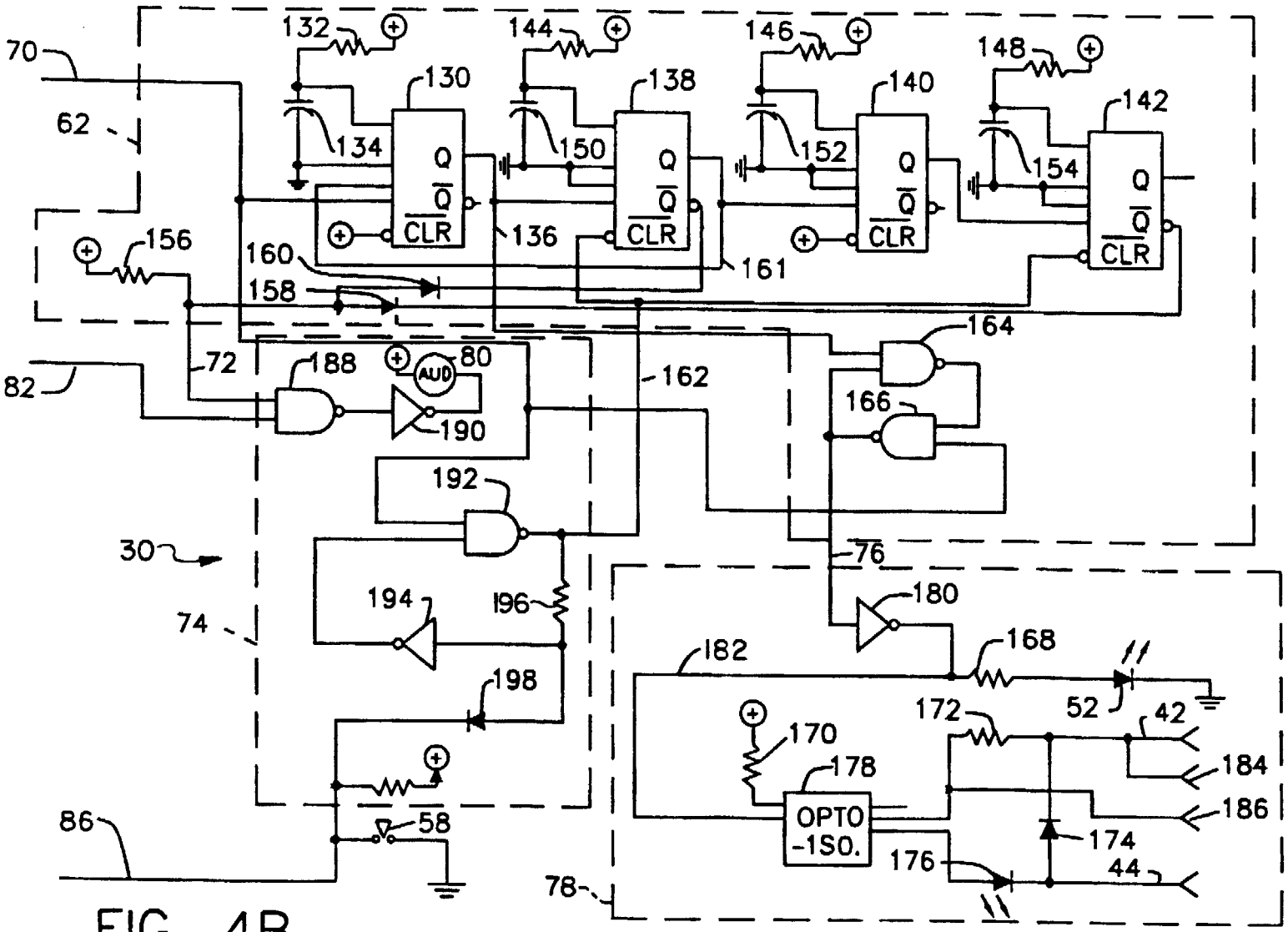

FIGS. 4A and 4B, when placed side-by-side, together provide a detailed schematic electric circuit diagram of an illustrative interface unit 30 according to this invention. As discussed above, the smoke detector interface 60 includes a high impedance interface Connected to the signalling wire 20. This interface also provides a sensing function responsive to the presence of a signalling voltage placed on the signalling wire 20 by any one of the smoke detectors 10. The high impedance interface is connected to the signalling wire 20 by a protective network which includes the resistor 88, the Zener diode 90 and the surge protector diode 92. This protective network prevents any voltage surges which may occur on the signalling wire 20 from damaging the interface unit 30 and also prevents any fault voltages which may occur within the interface unit 30 from reaching the smoke detectors 10.

The high impedance interface includes a constant current regulator made up of Darlington transistor 94, resistors 96 and 98, light emitting diode 100, and the input photodiode of opto-isolator 102. The constant current regulator is not operated within its normal linear range, but instead operates in a two state mode, depending on the voltage applied between the leads 20 and 16. At voltage levels below about two volts, the current through the regulator is maintained sufficiently low that the current flowing through the input photodiode of the opto-isolator 102 is at such a low level that the output phototransistor of the opto-isolator 102 remains in the OFF state. The resistor 103 maintains the input of the inverter/buffer 105 at a logic ZERO, causing a logic ONE to appear on the lead 82. As the voltage on the signalling wire 20 rises, the current through the current regulator increases so that when the voltage on the signalling wire 20 is at about three volts, there is sufficient current through the input photodiode of the opto-isolator 102 to cause the output phototransistor of the opto-isolator 102 to go into its ON state, applying the supply voltage to the lead 68, thereby causing the inverter/buffer 105 to apply a logic ZERO to the lead 82. The non-linear operation of the current regulator insures that a clean logic transition appears at the output of the opto-isolator 102 which is essentially, over the lower limits of its operating range, a linear device. The resistor 96 and the light emitting diode 100 provide a constant voltage reference at low current levels for the base of the Darlington transistor 94. The voltage across the resistor 98 is regulated to a value which is equal to the forward drop across the base to emitter junction of the transistor 94 and the voltage drop across the light emitting diode 100, in order to stabilize the current. The current is limited to a value which will not adversely affect the operation of the smoke detector control logic 26 via the signalling wire 20. At these low current levels, no light is visible from the light emitting diode 100, which is merely used as an inexpensive low current low voltage reference element. This variable high input impedance circuit provides proper operation of the smoke detector circuit over the normal operating range (i.e., about 3.0 volts to about 5.0 volts) on the signalling wire 20, without causing a high current drain on the particular one of the smoke detectors 10 which placed the voltage on the signalling wire 20. It is noted that the constant current regulator, which functions to sense the presence of the signalling voltage on the signalling wire 20, is isolated from any source of voltage other than the signalling wire 20.

The circuitry for monitoring the AC power wires 14, 16 includes the resistors 104, 106, 108, the diode 110 and the opto-isolator 112. AC line voltage normally appears across the wires 14, 16 and the resistor 104 has a relatively large value so as to limit the peak current through the input photodiode of the opto-isolator 112. The diode 110 prevents a reverse voltage in excess of that allowed by the input photodiode of the opto-isolator 112 from appearing across the input to the opto-isolator 112 during the "negative" swing of the 115 volt AC input. The current through the input photodiode of the opto-isolator 112 causes the output phototransistor thereof to conduct during most of the range on the positive input cycle of the AC power wire. The resistor 108, which is across the base and emitter of the output phototransistor of the opto-isolator 112, insures rapid turn off of the output phototransistor during negative cycles of the AC input, thereby causing a quasi-squarewave signal to appear on the AC output lead 70 at a 60 Hertz rate whenever AC power is present on the wires 14, 16. The resistor 106 provides a current source to the collector of the output phototransistor of the opto-isolator 112 and to other users of the signal on the lead 70.

To derive power from the power wires 14, 16 to generate the test signal which is placed on the signalling wire 20, there is provided a network which includes the capacitors 114, 116, the resistor 118, the diode 120 and the Zener diode 122. The 115 volt AC voltage swings across the power wires 14, 16 are converted into positive current pulses by the capacitor 114 and the diode 120, and are current limited by the resistor 118, to pump charge the capacitor 116 to a voltage limited by the Zener diode 122 (i.e., about 6.8 volts). This voltage forms the power source for the test signal to the smoke detectors 10. The test signal is a series of pulses whose duration and frequency are determined by the detector test controller 66, in a manner to be described in full detail hereinafter, and are of a form applied to the test command input lead 64. The test signal on the lead 64 is applied to the input of the inverter 124, whose output drives the input photodiode of the opto-isolator 126, causing the output phototransistor thereof to conduct. This applies the voltage available across the capacitor 116 to the signalling wire 20 through the diode 128 and the protective network made up of the resistor 88 and the diodes 90, 92 previously described. Illustratively, the test signal on the lead 64 is a series of pulses every twenty seconds. Each of the pulses is sufficiently long enough to cause the audible alarms 24 to sound briefly in each of the smoke detectors 10 connected by the signalling wire 20. All working connected smoke detectors 10 should sound briefly, enabling the user to walk through the house and determine if there is a malfunction. Since power for generating the test signal applied to the signalling wire 20 is derived from the AC power on the power wires 14, 16, testing cannot be performed when there is an AC power failure, thereby conserving the backup batteries of the smoke detectors 10.

As previously described, a quasi-squarewave signal appears on the lead 70 when AC power is present on the power wires 14, 16. The determination that AC power has failed for a long enough period of time to warrant an alarm indication is made by precision retriggerable monostable multivibrator 130, illustratively a Motorola 14538, together with the resistor 132 and the capacitor 134. The multivibrator 130 is a device whose output remains in the TRUE state for a time equal to the value of the resistor 132 times the value of the capacitor 134 when input trigger conditions are met. The multivibrator 130 is retriggerable so that if the input conditions necessary for triggering reoccur while the device is in its TRUE state, then the time during which it remains in its TRUE state is restarted. Illustratively, the time constant of the multivibrator 130, as determined by the values of the resistor 132 and the capacitor 134, is selected to be approximately twenty-two seconds. So long as AC power is present on the power wires 14, 16, the multivibrator 130 is continually triggered by the quasi-squarewave signal on the lead 70 and its output on the lead 136 is maintained at a logic ONE. However, if the AC disappears from the power wires 14, 16, the signal on the AC output lead 70 becomes a continuous logic ONE, and if this occurs for more than approximately twenty-two seconds, the signal on the lead 136 at the output of the multivibrator 130 becomes a logic ZERO.

As previously discussed, the audible indication for AC power failure is different from the audible indication for smoke detection. Illustratively, a "double beep" is generated in response to the sensing of AC failure. For generating this "double beep", there are provided the retriggerable monostable multivibrators 138, 140, 142, along with their respective timing resistors 144, 146, 148 and capacitors 150, 152, 154, respectively, together with the resistor 156 and the diodes 158, 160. Preferably, the resistors 144, 146, 148 and the capacitors 150, 152, 154 are selected so that the time constants of the multivibrators 138, 140, 142 are each approximately one second. When there is an AC failure and the signal on the lead 136 changes from a logic ONE to a logic ZERO, the multivibrator 138 will change state for one second. Due to the feedback along the lead 161 back to the input of the multivibrator 130, the multivibrator 130 will change state for about twenty seconds. The net result is that the multivibrator 138 will generate a one second pulse every twenty seconds on the lead 161, because the continued absence of a transition on the lead 70 due to AC power failure will cause the multivibrator 130 to "time out" every twenty seconds, triggering the multivibrator 138. When the multivibrator 138 is triggered, the logic ONE to logic ZERO transition on the lead 161 which occurs at the end of its one second time period triggers the multivibrator 140 for one second and at the end of the one second cycle of the multivibrator 140, the multivibrator 142 is triggered for one second. Thus, every time that the multivibrator 130 "times out", the multivibrators 138, 140, 142 each in turn generates a one second pulse. The diodes 158, 160 and the resistor 156 in combination function as a two input negative true OR gate, to convert the output pulses from the multivibrators 138 and 142 into two one second pulses separated by one second, thereby providing the "double beep" on the lead 72. Customizing of this "double beep" may be effected by changing the time constants of the multivibrators 138, 140, 142.

The CLR inputs of the multivibrators 138 and 142 are connected together and are driven by the silence signal on the lead 162 from the audible alarm controller 74. When this signal is TRUE it is a logic ZERO. A logic ZERO on the CLR inputs of the multivibrator 138, 142 causes them to immediately go to the non-triggered state which terminates the signal on the lead 72 as well as preventing subsequent retriggerings of the chain of multivibrators 130, 138, 140, 142. The first logic ONE to logic ZERO transition on the lead 70 resets the silence signal on the lead 162. Momentary reoccurrences of AC on the power wires 14, 16 will cause new alarms to be generated if the AC power is not restored "permanently" within a twenty second period.

The two two-input NAND gates 164, 166 are connected together to form a set/reset latch for providing an indication as to whether or not there is AC failure. When the signal on the lead 136 changes from a logic ONE to a logic ZERO, indicating AC failure for at least twenty seconds, this changes the output of the latch on the lead 76 from a logic ONE to a logic ZERO, which corresponds to the AC failure state. The second logic ONE to logic ZERO transition on the AC output lead 70 resets the latch so that its output on the lead 76 changes from a logic ZERO to a logic ONE, corresponding to the end of the AC failure state.

Visual indication and alarm panel notification of AC failure is performed by the alarm panel notification circuit 78. This circuit includes the resistors 168, 170, 172, the diode 174, the light emitting diode 52, 176, the opto-isolator 178 and the inverter/buffer 180. When there is an AC failure and the signal on the lead 76 goes low because the latch 164, 166 is set, the output of the inverter/buffer 180 goes high, causing the light emitting diode 52 to be energized. The light emitting diode 52 is visible on the front panel of the interface unit 30. The current through the light emitting diode 52 is limited by the resistor 168.

The loop to the central alarm panel 28 is by means of the wires 42, 44, with the more positive lead being the wire 42. The diode 174 provides reverse polarity protection. When AC power is present, the output of the inverter/buffer on the lead 182 is low, which turns off the light emitting diode 52 and allows current to flow through the input photodiode of the opto-isolator 178, this current being limited by the resistor 170. This current causes the output phototransistor in the opto-isolator 178 to turn on, thereby allowing current to flow between the wires 42, 44. The light emitting diode 176 is energized to indicate to a technician that the external connections are properly made when AC power is present. Upon failure of the AC power, the light emitting diode 176 is extinguished. The current through the light emitting diode 176 is limited by the resistor 172 and by the intrinsic impedance of the central alarm panel 28, together with the impedance of the interconnecting wires. Various central alarm panel manufacturers provide specifications as to what the equivalent impedance of the alarm loop circuitry should be. From this specification, the value of the resistor 172 can be calculated. Preferably, this resistance value is calculated for systems in the field requiring the highest impedance. For other systems having lower values of impedance, an external resistor can be connected across the terminals 184, 186, the value of which can be calculated using basic circuit theory.

The audible alarm 80 is preferably a self-contained piezoelectric oscillator/transducer. The two-input NAND gate 188 and the inverter/buffer 190 are interconnected to provide the equivalent of a two input (low true) OR gate with a buffered output for driving the audible indicator 80. When the smoke signal on the lead 82 from the smoke detector interface 60 goes to a logic ZERO, the audible indicator 80 sounds continuously for the duration of the smoke alarm state. When the double beep signal on the lead 72 goes to a logic ZERO, it causes the indicator 80 to sound every twenty seconds with two one-second beeps separated by one second, for the duration of the AC failure state or until the silence button 58 is actuated.

The silence button 58 is coupled to the input of a set/reset latch comprising the two-input NAND gate 192, the inverter/buffer 194 and the resistor 196. This latch is reset by the first logic ONE to logic ZERO transition on the AC output lead 70 to allow double beep generation. When the silence button 58 is actuated, the latch is set to prevent double beep generation. The diode 198 provides isolation so that actuation of the silence button 58 may also be used to terminate the test mode by providing a ground signal on the lead 86.

To control the testing of the smoke detectors 10, the detector test controller 66 is provided with retriggerable monostable multivibrator 200, resistor 202, capacitor 204, resistors 206, 208, inverter/buffer 210, as well as the test light emitting diode 54 and the test button 56. The values of the resistor 202 and capacitor 204 are selected so that when the test button 56 is operated, the multivibrator 200 is triggered into its test mode state for a period of approximately five minutes. Subsequent operation of the test button 56 during this period will cause the test time to be restarted. During this period, the inverter/buffer 210 drives the light emitting diode 54, with the resistor 208 limiting the current through the light emitting diode 54. When the multivibrator 200 is not in its test mode state, the output of the inverter/buffer 210 provides current to the alarm panel notification circuit 84, through the resistor 212 and over the test mode lead 65. Otherwise, when the multivibrator 200 is in its test mode state, operation of the alarm panel notification circuit 84 is inhibited. A logic ZERO on the lead 86 from the silence button 58 immediately terminates the test mode of the multivibrator 200.

When the multivibrator 200 is in its test mode, its output on the lead 214 enables test pulse generation. The test pulse generation function is provided by retriggerable monostable multivibrators 216, 218, 220, the resistors 222, 224, 226 and the capacitors 228, 230, 232. The values of the resistor 222 and the capacitor 228 are selected so that the period of the multivibrator 216 is approximately one second. The values of the resistor 224 and the capacitor 230 are selected so that the period of the multivibrator 218 is approximately twenty seconds. The values of the resistor 226 and the capacitor 232 are selected so that the period of the multivibrator 220 is approximately ten milliseconds. The multivibrators 218, 220 are connected "nose to tail" to function as a continuous (free running) oscillator with a period of operation of about twenty seconds and with an output pulse width of about ten milliseconds on the lead 234. The pulse on the lead 234 is applied to the triggering input of the multivibrator 216. Until the output of the multivibrator 200 on the lead 214 is at a logic ONE, the clear input of the multivibrator 216 is held at logic ZERO, preventing the multivibrator 216 from responding to the triggering pulses on the lead 234. When the multivibrator 200 goes into the test mode so that the signal on the lead 214 goes to a logic ONE, the multivibrator 216 can respond to the triggering pulses on the lead 234 and produce a test pulse on the lead 64 approximately one second long every twenty seconds.

The loop to the remote alarm panel 28 in order to notify the alarm panel 28 of the detection of smoke by one of the smoke detectors 10 is over the wires 38, 40, with the wire 38 being more positive than the wire 40. The diode 236 provides reverse polarity protection. The remainder of the notification circuitry 84 includes the opto-isolator 238, the Darlington transistor 240, the resistors 242, 244, and the light emitting diode 246. When the multivibrator 200 is not in its test mode state, the output of the inverter/buffer 210 is at a logic ONE. When smoke has not been detected, the lead 82 is also at a logic ONE, so that there is no current flow through the input photodiode of the opto-isolator 238. This allows the resistor 244 to supply current to the base of the Darlington transistor 240, causing current to flow in the loop towards the alarm panel 28. The light emitting diode 246 is illuminated to show that the external connections are properly made where there is no smoke detected. (There is no current through the light emitting diode 246 when smoke is detected.) The current in the loop including the wires 38, 40 is subject to the same conditions and considerations as discussed above with regard to the current through the loop including the wires 42, 44, so that an external resistor may be required to be connected across the terminals 248, 250.

When smoke is detected by one of the smoke detectors 10, the signal on the lead 82 goes to a logic ZERO, so that current flows through the input photodiode of the opto-isolator 238. This causes the output phototransistor of the opto-isolator 238 to turn on, bringing the voltage at the base of the Darlington transistor 240 to a slightly negative value due to the drop across the light emitting diode 246. This insures complete cut off of the Darlington transistor 240 and the transmission of an alarm indication to the remote alarm panel 28. This particular implementation of the smoke detection loop and the AC failure loop to the alarm panel 28 is designed to cause minimum current drain from the alarm panel power leads 46, 48 during AC power failure conditions, thereby conserving alarm panel battery life.

Accordingly, there has been described an interface unit adapted to be interposed between a plurality of alarm devices and an alarm panel for signalling the alarm panel when any one of a plurality of alarm devices senses an alarm condition and for providing a controlled test capability of the alarm devices. This interface unit is readily retrofitted to an existing alarm device installation. The sensing of the alarm condition by the interface unit is accomplished without providing any source of voltage to the sensing circuitry, other than that provided from the alarm devices themselves. Further, the use of opto-isolators provides electrical isolation between the sensing circuitry and the alarm panel notification circuitry. Still further, during a test of the alarm devices, the alarm panel notification circuitry is disabled, so that false alarm signals are not transmitted to the alarm panel. In addition, AC power failure is detected by the interface unit. Audible alarms are generated by the interface unit, and these audible alarms are distinguishable between the conditions of alarm sensing and AC power failure sensing. Further, the audible alarm for AC power failure can be silenced, but not the audible alarm for alarm condition detection.

While a preferred embodiment of the present invention has been disclosed herein, it is understood that various modifications and adaptations to the disclosed embodiment will be apparent to those of ordinary skill in the art and it is intended that this invention be limited only by the scope of the appended claims.

What is claimed is:

1. An interface unit adapted to be interposed between at least one alarm device and an alarm panel: the at least one alarm device being coupled to a signalling wire and being arranged to provide a predetermined voltage on the signalling wire in response to the sensing of alarm condition: the at least one alarm device being further arranged to provide an audible signal in response to sensing the predetermined voltage on the signalling wire, the interface unit comprising;

connection means for providing a connection to said signalling wire;

sensing means having an input coupled to said connection means and responsive to the presence of said predetermined voltage on said signalling wire for providing a predetermined electrical current at an output of said sensing means, said sensing means being isolated from any source of voltage other than said signalling wire: and alarm notification means coupled to the output of sensing means and responsive to said predetermined electrical current for providing an alarm condition signal to said alarm panel, said alarm notification means being electrically isolated from said sensing means:

wherein said sensing means includes a light emitting diode and said alarm notification means includes a phototransistor in light communication with said light emitting diode.

2. The interface unit according to claim 1 wherein said sensing means further includes:

a pair of transistors connected in a Darlington configuration in series with said light emitting diode; and a voltage reference diode in series with said light emitting diode and the input of said Darlington configured transistors, said voltage reference diode having the same polarity as said light emitting diode;

wherein said light emitting diode, said voltage reference diode and said transistors are selected so that the sum of the voltage drops of the light emitting diode, the voltage reference diode and the input of said Darlington configured transistors substantially equals said predetermined voltage.

3. An interface unit adapted to be interposed between at least one alarm device and an alarm panel, the at least one alarm device being coupled to a signalling wire and being arranged to provide a predetermined voltage on the signalling wire in response to the sensing of an alarm condition, the at least one alarm device being further arranged to provide an audible signal in response to sensing the predetermined voltage on the signalling wire, the interface unit comprising:

connection means for providing a connection to said signalling wire:

sensing means having an input coupled to said connection means and responsive to the presence of said predetermined voltage on said signalling wire for providing a predetermined electrical current at an output of said sensing means, said sensing means being isolated from any source of voltage other than said signalling wire:

alarm notification means coupled to the output of said sensing means and responsive to said predetermined electrical current for providing an alarm condition signal to said alarm panel;

test switch means operable into a test state for initiating a test of the at least one alarm device;

voltage providing means responsive to the test switch means being in the test state for applying the predetermined voltage to the signalling wire; and inhibit means responsive to the test switch means being in the test state for inhibiting operation of the alarm notification means.

4. The interface unit according to claim 3 wherein said voltage providing means is effective to apply the predetermined voltage to the signalling wire as a series of time-spaced voltage pulses.

5. The interface unit according to claim 4 wherein said test switch means includes a momentary contact switch and said voltage providing means includes timing means responsive to operation of said momentary contact switch for timing a predetermined interval at the expiration of which said voltage providing means ceases applying the predetermined voltage to the signalling wire.

6. The interface unit according to claim 3 wherein said test switch means includes:

a two-state device normally in a first state, said two-state device having an input and being responsive to the application of a reference potential at its input for switching into the test state for a predetermined time; and an operator influenced test switch arranged to selectively apply said reference potential to said two-state device input when actuated by an operator.

7. The interface unit according to claim 6 wherein said two-state device further has a reset input and is responsive to the application of a predetermined voltage to said reset input for reverting to said first state, said interface unit further including:

an operator influenced test termination switch for selectively applying said predetermined voltage to said reset input.

8. The interface unit according to claim 3 wherein the signalling wire is part of a three wire bus having a pair of wires connectable to an AC power source for providing primary power to the at least one alarm device and the voltage providing means is powered from the two AC wires of the bus, whereby testing of the at least one alarm device is inhibited in the absence of AC power on the bus.

9. An interface unit adapted to be interposed between at least one alarm device and an alarm panel, the at least one alarm device being coupled to a signalling wire and being arranged to provide a predetermined voltage on the signalling wire in response to the sensing of an alarm condition, the at least one alarm device being further arranged to provide an audible signal in response to sensing the predetermined voltage on the signalling wire, the signalling wire being part of a three wire bus having a pair of wires connectable to an AC power source for providing primary power to the at least one alarm device, the interface unit comprising:

connection means for providing a connection to said signalling wire:

sensing means having an input coupled to said connection means and responsive to the presence of said predetermined voltage on said signalling wire for providing a predetermined electrical current at an output of said sensing means, said sensing means being isolated from any source of voltage other than said signalling wire;

alarm notification means coupled to the output of said sensing means and responsive to said predetermined electrical current for providing an alarm condition signal to said alarm panel;

AC monitor means coupled to the two AC wires of the bus for providing a first signal when AC power is not present on the bus;

AC failure detection means responsive to said first signal for providing an AC failure signal; and power failure notification means responsive to said AC failure signal for providing a power failure signal to said alarm panel.

10. The interface unit according to claim 9 wherein said AC monitor means comprises:

an opto-isolator having an input light emitting diode and an output phototransistor;

means for coupling said input light emitting diode to the two AC wires of the bus;

means for coupling the emitter of the output phototransistor to a first reference potential;

a resistor having a first end connected to a second reference potential; and means for coupling the collector of the output phototransistor to the second end of the resistor and to the AC failure detection means;

whereby the first signal provided by the AC monitor means when AC power is not present on the bus is continuously at the second reference potential.

11. The interface unit according to claim 10 further including:

audible alarm means responsive to said first signal for providing an audible alarm indicative of AC power failure.

12. The interface unit according to claim 9 further including:

audible alarm means responsive to an alarm voltage applied thereto for generating an alarm sound;

first alarm voltage generating means responsive to the provision of said alarm condition signal by said alarm notification means for applying said alarm voltage to said audible alarm means in a first time dependent pattern; and second alarm voltage generating means responsive to the provision of said AC failure signal by said AC failure detection means for applying said alarm voltage to said audible alarm means in a second time dependent pattern.

13. The interface unit according to claim 12 wherein the alarm notification means, the AC failure detection means, the power failure notification means and the first and second alarm voltage generating means all receive power from the alarm panel.

14. An interface unit interposed between at least one alarm device and an alarm panel, the interface unit and the at least one alarm device being interconnected by a three wire bus wherein two of the bus wires are adapted for connection to a source of AC power for powering the at least one alarm device and the third of the bus wires is a signalling wire, the at least one alarm device being arranged to provide a predetermined voltage on the signalling wire in response to the sensing of an alarm condition, the at least one alarm device being further arranged to monitor the voltage level of the signalling wire and generate an audible signal upon sensing the predetermined voltage on the signalling wire, the interface unit comprising:

alarm notification means for monitoring the voltage on the signalling wire and responsive to the presence of the predetermined voltage on the signalling wire for providing an alarm condition signal to the alarm panel indicative of the sensing of the alarm condition by the at least one alarm device;

test switch means operable into a test state for initiating a test of the at least one alarm device;

voltage providing means responsive to the test switch means being in the test state for applying the predetermined voltage to the signalling wire; and inhibit means responsive to the test switch means being in the test state for inhibiting operation of the alarm notification means.

15. The interface unit according to claim 14 wherein said voltage providing means is effective to apply the predetermined voltage to the signalling wire as a series of time-spaced voltage pulses.

16. The interface unit according to claim 15 wherein said test switch means includes a momentary contact switch and said voltage providing means includes timing means responsive to operation of said momentary contact switch for timing a predetermined interval at the expiration of which said voltage providing means ceases applying the predetermined voltage to the signalling wire.

17. The interface unit according to claim 14 further including:

AC monitor means coupled to the two AC wires of the bus for providing a first signal when AC power is not present on the bus;

AC failure detection means responsive to said first signal for providing an AC failure signal; and power failure notification means responsive to said AC failure signal for providing a power failure signal to said alarm panel.

18. The interface unit according to claim 17 wherein said AC monitor means comprises:

an opto-isolator having an input light emitting diode and an output phototransistor;

means for coupling said input light emitting diode to the two AC wires of the bus;

means for coupling the emitter of the output phototransistor to a first reference potential;

a resistor having a first end connected to a second reference potential; and means for coupling the collector of the output phototransistor to the second end of the resistor and to the AC failure detection means;

whereby the first signal provided by the AC monitor means when AC power is not present on the bus is continuously at the second reference potential.

19. The interface unit according to claim 18 further including:

audible alarm means responsive to said first signal for providing an audible alarm indicative of AC power failure.

20. The interface unit according to claim 14 wherein the test switch means includes:

a two-state device normally in a first state, said two-state device having an input and being responsive to the application of a reference potential at its input for switching into the test state for a predetermined time; and an operator influenced test switch arranged to selectively apply said reference potential to said two-state device input when actuated by an operator.

21. The interface unit according to claim 20 wherein said two-state device further has a reset input and is responsive to the application of a predetermined voltage to said reset input for reverting to said first state, said interface unit further including:

an operator influenced test termination switch for selectively applying said predetermined voltage to said reset input.

22. The interface unit according to claim 17 further including:

audible alarm means responsive to an alarm voltage applied thereto for generating an alarm sound;

first alarm voltage generating means responsive to the provision of said alarm condition signal by said alarm notification means for applying said alarm voltage to said audible alarm means in a first time dependent pattern; and second alarm voltage generating means responsive to the provision of said AC failure signal by said AC failure detection means for applying said alarm voltage to said audible alarm means in a second time dependent pattern.

23. The interface unit according to claim 22 wherein the alarm notification means, the AC failure detection means, the power failure notification means and the first and second alarm voltage generating means all receive power from the alarm panel.

24. The interface unit according to claim 14 wherein said at least one alarm device is a smoke detector.

25. The interface unit according to claim 14 wherein the voltage providing means is powered from the two AC wires of the bus, whereby testing of the at least one alarm device is inhibited in the absence of AC power on the bus.

* * * * *